US010369452B2

(12) United States Patent
Jimenez

(10) Patent No.: US 10,369,452 B2
(45) Date of Patent: Aug. 6, 2019

(54) PADDING ASSEMBLY

(71) Applicant: Chris Jimenez, Greece, NY (US)

(72) Inventor: Chris Jimenez, Greece, NY (US)

( * ) Notice: Subject to any disclaimer, the term of this patent is extended or adjusted under 35 U.S.C. 154(b) by 122 days.

(21) Appl. No.: 15/463,518

(22) Filed: Mar. 20, 2017

(65) Prior Publication Data

US 2018/0264346 A1 Sep. 20, 2018

(51) Int. Cl.

| | |
|---|---|
| ***A42B 3/12*** | (2006.01) |
| ***A63B 71/10*** | (2006.01) |
| ***A42B 3/06*** | (2006.01) |
| *A42B 3/04* | (2006.01) |

(52) U.S. Cl.

CPC ..... *A63B 71/10* (2013.01); *A42B 3/069* (2013.01)

(58) Field of Classification Search

CPC ..... A42B 3/069; A42B 3/003; A42B 3/00; A42B 3/06; A42B 3/065; A42B 3/127; A41D 13/015; A42C 2/00; A63B 71/08

See application file for complete search history.

(56) References Cited

U.S. PATENT DOCUMENTS 3,935,044 A * 1/1976 Daly ..... A42C 2/00 156/79
4,282,610 A * 8/1981 Steigerwald ..... A42B 3/127 2/414
4,326,303 A * 4/1982 Rappleyea ..... A42B 3/08 2/411
4,660,230 A * 4/1987 Mayling ..... A42B 3/069 2/413
4,912,777 A * 4/1990 Gasbarro ..... A42B 1/12 2/2.15
5,136,657 A * 8/1992 Hattori ..... A42B 3/127 2/421
5,173,970 A * 12/1992 Shifrin ..... A42B 1/08 2/209.12
5,361,410 A * 11/1994 Sigl ..... A41D 13/015 2/22
RE35,193 E * 4/1996 Shifrin ..... A42B 1/08 2/209.12
5,724,681 A * 3/1998 Sykes ..... A42B 3/003 2/411
6,055,676 A * 5/2000 Bainbridge ..... A41D 13/015 2/16
6,266,827 B1 * 7/2001 Lampe ..... A42B 3/00 2/414
6,272,692 B1 * 8/2001 Abraham ..... A42B 3/063 2/411
6,282,724 B1 * 9/2001 Abraham ..... A41D 13/015 2/267
6,301,722 B1 * 10/2001 Nickerson ..... A41D 13/015 2/22
6,314,586 B1 * 11/2001 Duguid ..... A42B 3/069 2/411
6,349,416 B1 * 2/2002 Lampe ..... A42B 3/00 2/411
6,381,760 B1 * 5/2002 Lampe ..... A42B 3/00 2/414

(Continued)

*Primary Examiner* — Robert H Muromoto, Jr.

(57) ABSTRACT

A padding assembly for a helmet includes a plurality of pads that is configured to couple to an external surface of the helmet, such as a football helmet. The pads are configured to absorb a force from an impact to the helmet when the helmet is positioned on a head of a user. The force of the impact to the head of the user is reduced.

11 Claims, 5 Drawing Sheets

(56) References Cited

U.S. PATENT DOCUMENTS 7,103,923 B2 * 9/2006 Picotte ..... A42B 1/08 2/171
7,171,696 B2 * 2/2007 Falone ..... A41D 13/015 2/161.1
7,464,414 B2 * 12/2008 McDuff ..... A42B 3/127 2/455
7,904,971 B2 * 3/2011 Doria ..... A42B 3/127 2/410
8,387,164 B2 * 3/2013 Maddux ..... A42B 3/127 2/424
8,707,470 B1 * 4/2014 Novicky ..... A42B 3/069 2/411
8,719,965 B2 * 5/2014 Turner ..... A41D 13/0506 2/228
D710,058 S * 7/2014 Johnson ..... D29/106
8,763,166 B1 * 7/2014 Olivares Velasco ... A42B 3/125 2/171
8,776,272 B1 * 7/2014 Straus ..... A42B 3/003 2/411
8,826,468 B2 * 9/2014 Harris ..... A42B 3/069 2/411
8,966,671 B2 * 3/2015 Rumbaugh ..... A42B 3/065 2/410
9,119,431 B2 * 9/2015 Bain ..... A42B 3/069
9,314,060 B2 * 4/2016 Giles ..... A42B 3/18
9,314,061 B2 * 4/2016 Hanson ..... A42B 3/003
9,370,215 B1 * 6/2016 Straus ..... A42B 3/003
9,622,533 B2 * 4/2017 Warmouth ..... A42B 3/122
9,763,488 B2 * 9/2017 Bologna ..... A42B 3/127
9,775,394 B2 * 10/2017 Dagan ..... A42B 3/00
9,833,684 B2 * 12/2017 Warmouth ..... A42B 3/20
9,943,129 B2 * 4/2018 Newman ..... A42B 3/20
9,943,747 B2 * 4/2018 Erb ..... A42B 3/127
9,961,952 B2 * 5/2018 Durocher ..... A42B 3/127
2004/0107482 A1 * 6/2004 Picotte ..... A42B 1/08 2/411
2005/0114985 A1 * 6/2005 Falone ..... A41D 13/015 2/161.1
2005/0278835 A1 * 12/2005 Ide ..... A42B 3/08 2/424
2006/0162054 A1 * 7/2006 Lardeau ..... A42B 3/127 2/414
2006/0260026 A1 * 11/2006 Doria ..... A42B 3/127 2/414
2007/0192943 A1 * 8/2007 McDuff ..... A42B 3/127 2/410
2009/0044319 A1 * 2/2009 Lamson ..... A41D 13/05 2/459
2011/0047680 A1 * 3/2011 Hoying ..... A42B 3/069 2/414
2011/0131695 A1 * 6/2011 Maddux ..... A42B 3/18 2/9
2012/0017358 A1 * 1/2012 Princip ..... A42B 3/064 2/414
2012/0198605 A1 * 8/2012 Maddux ..... A42B 3/18 2/414
2012/0255105 A1 * 10/2012 Turner ..... A41D 13/0506 2/455
2012/0297525 A1 * 11/2012 Bain ..... A42B 3/003 2/411
2012/0297526 A1 * 11/2012 Leon ..... A42B 3/12 2/413
2013/0000017 A1 * 1/2013 Szalkowski ..... A42B 3/127 2/414
2013/0061375 A1 * 3/2013 Bologna ..... A42B 3/127 2/414
2013/0283504 A1 * 10/2013 Harris ..... A42B 3/127 2/411
2013/0312152 A1 * 11/2013 Paul ..... A41D 13/015 2/16
2014/0173815 A1 * 6/2014 Grogro ..... A41D 13/015 2/461
2014/0223641 A1 * 8/2014 Henderson ..... A42B 3/065 2/411
2014/0259333 A1 * 9/2014 Marquez ..... A63B 71/12 2/459
2014/0289938 A1 * 10/2014 Brown ..... A41D 13/015 2/455
2014/0325745 A1 * 11/2014 Erb ..... A42B 3/127 2/414
2014/0359912 A1 * 12/2014 Sutton ..... A63B 71/1225 2/16
2015/0020573 A1 * 1/2015 Schofalvi ..... C08G 18/10 73/23.2
2015/0101096 A1 * 4/2015 Turner ..... A41D 13/05 2/23
2015/0164173 A1 * 6/2015 West ..... A42B 3/069 2/414
2015/0164174 A1 * 6/2015 West ..... A42B 3/069 2/414
2015/0216247 A1 * 8/2015 Price ..... A42B 3/125 2/414
2015/0237945 A1 * 8/2015 Vito ..... A42B 3/127 2/414
2016/0015111 A1 * 1/2016 Latruffe ..... A42B 3/06 2/412
2016/0029732 A1 * 2/2016 Columbis ..... A42B 3/003 2/414
2016/0198681 A1 * 7/2016 Fyfe ..... A42B 3/124 428/68
2016/0199721 A1 * 7/2016 Erb ..... A42B 3/127 2/414
2016/0377139 A1 * 12/2016 Vito ..... B32B 5/024 267/141
2017/0013907 A1 * 1/2017 Salmini ..... A42B 3/127
2017/0042271 A1 * 2/2017 Tuttle ..... A42B 3/121
2017/0122855 A1 * 5/2017 Dantus ..... A63B 71/08
2017/0273389 A1 * 9/2017 Muller ..... A42C 5/02
2017/0280814 A1 * 10/2017 Tuttle ..... A42B 3/08
2017/0303624 A1 * 10/2017 Vito ..... A42B 3/20
2017/0318890 A1 * 11/2017 Stolker ..... A42B 3/069
2018/0035739 A1 * 2/2018 Cohen ..... A42C 2/00
2018/0042329 A1 * 2/2018 Grice ..... A42B 3/064
2018/0042331 A1 * 2/2018 Bologna ..... A42B 3/127
2018/0092420 A1 * 4/2018 Lewis ..... A42B 3/069
2018/0110281 A1 * 4/2018 Morgan ..... A42B 3/064
2018/0160761 A1 * 6/2018 Al Kuwari ..... A42B 3/286
2018/0213874 A1 * 8/2018 Lanner ..... A42B 3/064

* cited by examiner

PADDING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to padding assemblies and more particularly pertains to a new padding assembly for a helmet.

BRIEF SUMMARY OF THE INVENTION

An embodiment of the disclosure meets the needs presented above by generally comprising a plurality of pads that is configured to couple to an external surface of a helmet, such as a football helmet. The pads are configured to absorb a force from an impact to the helmet when the helmet is positioned on a head of a user. The force of the impact to the head of the user is reduced.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
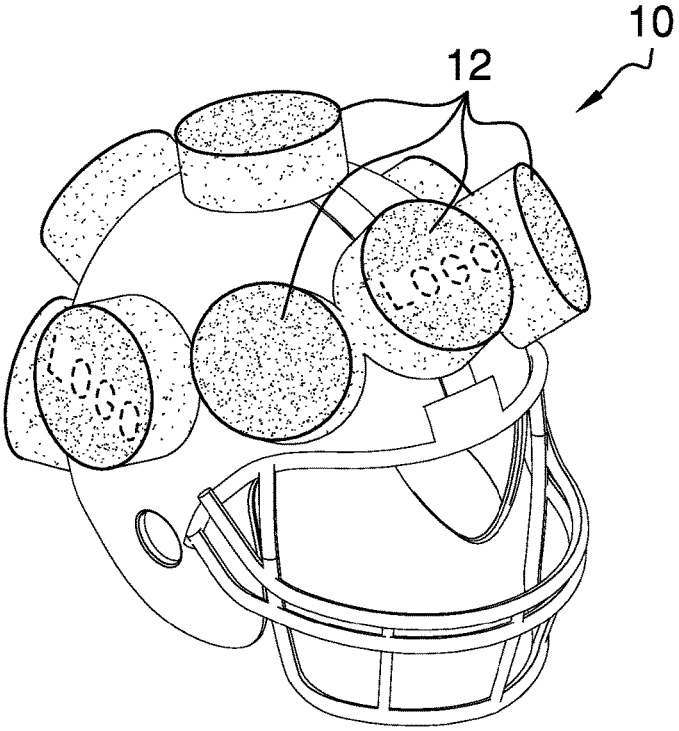
FIG. 1 is an isometric perspective view of a padding assembly according to an embodiment of the disclosure.
Figure 2:
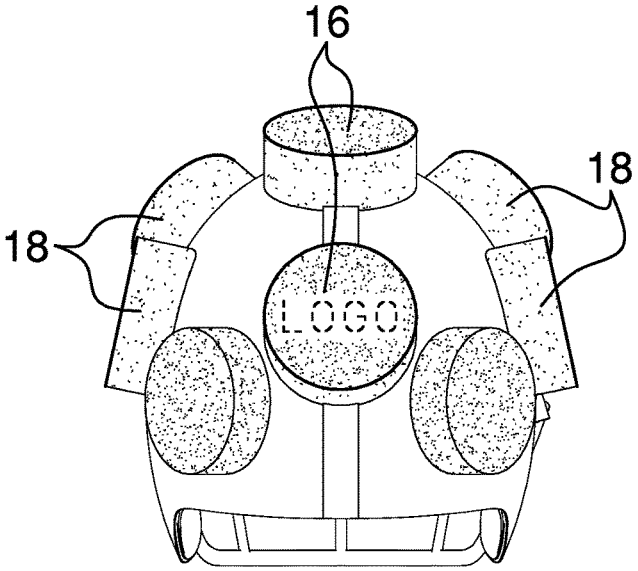
FIG. 2 is a back view of an embodiment of the disclosure.
Figure 3:
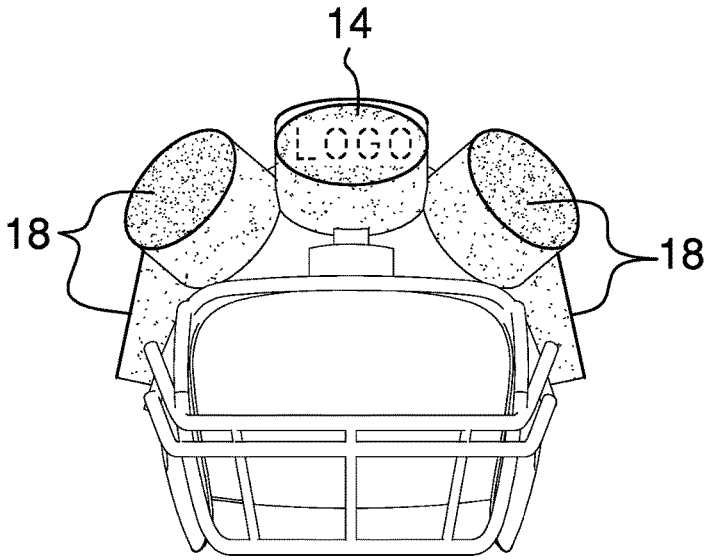
FIG. 3 is a front view of an embodiment of the disclosure.
Figure 4:
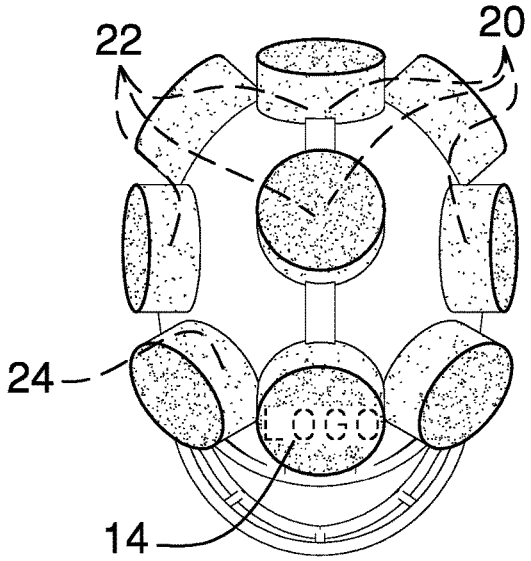
FIG. 4 is a top view of an embodiment of the disclosure.
Figure 5:
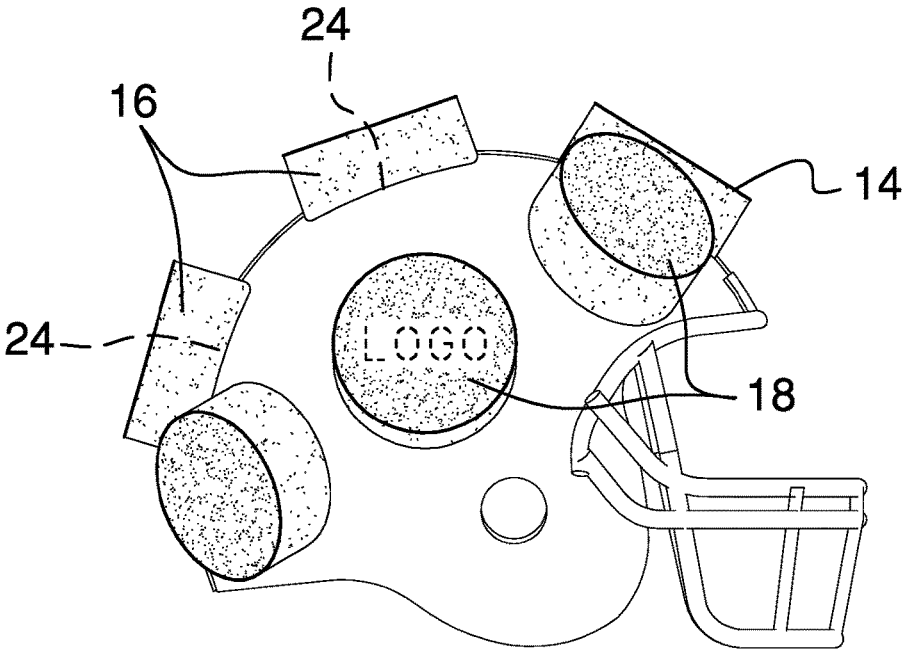
FIG. 5 is a side view of an embodiment of the disclosure.
Figure 6:
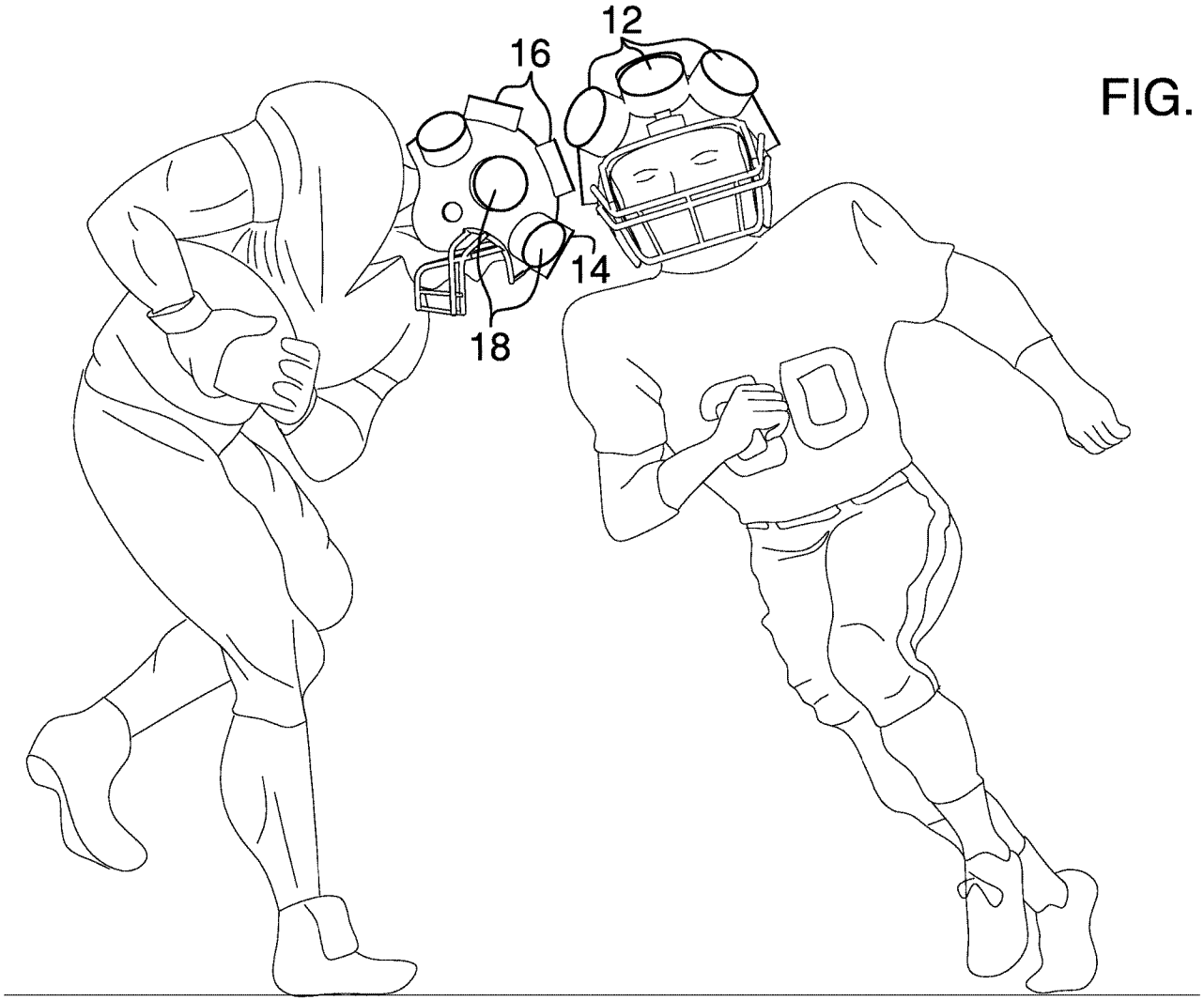
FIG. 6 is an in-use view of an embodiment of the disclosure.
Figure 7:
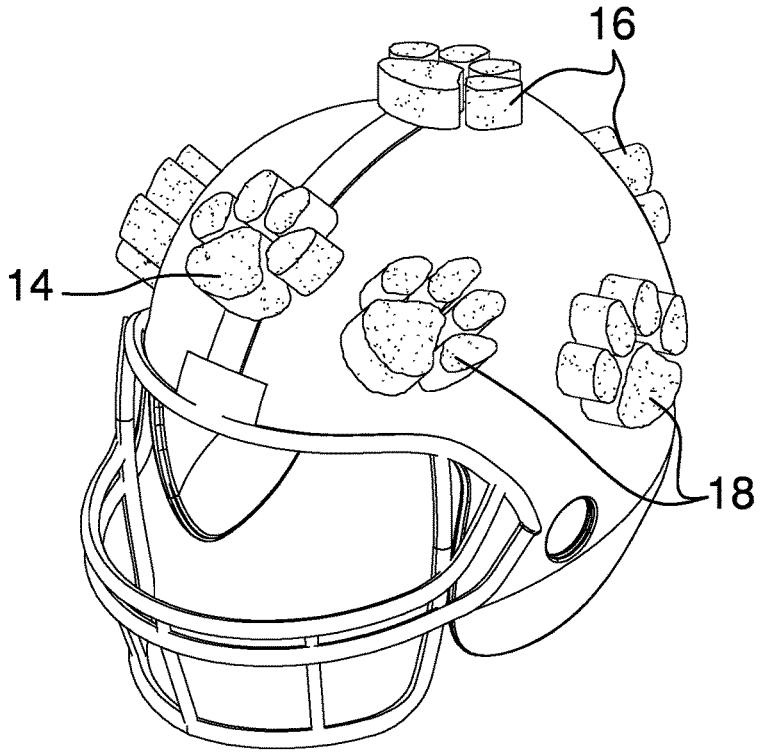
FIG. 7 is an isometric perspective view of an embodiment of the disclosure.
Figure 8:
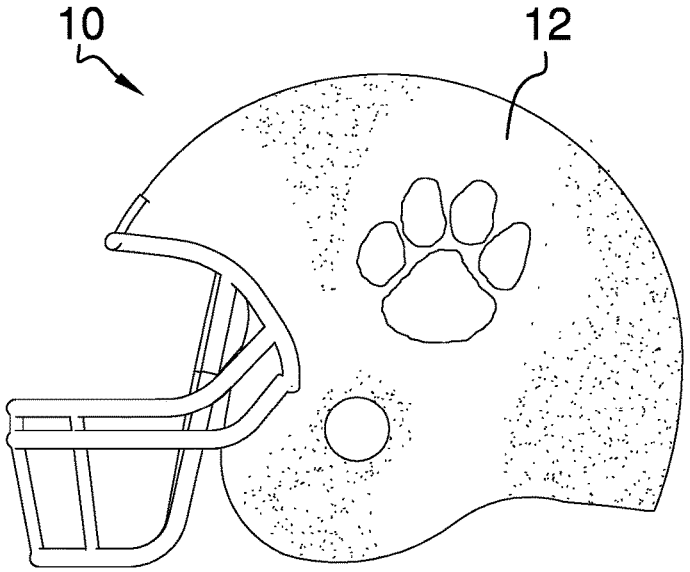
FIG. 8 is a side view of an embodiment of the disclosure.

With reference now to the drawings, and in particular to FIGS. 1 through 8 thereof, a new padding assembly embodying the principles and concepts of an embodiment of the disclosure and generally designated by the reference numeral 10 will be described.

As best illustrated in FIGS. 1 through 8, the padding assembly 10 generally comprises a plurality of pads 12 that is configured to couple to an external surface of a helmet, such as a football helmet. The pads 12 are configured to absorb a force from an impact to the helmet when the helmet is positioned on a head of a user. The force of the impact to the head of the user is reduced. In one embodiment, the plurality of pads 12 comprises one pad 12 configured to cover substantially all of the external surface of the helmet.

In one embodiment, the pads 12 comprise foam. In another embodiment, the pads 12 comprise pliable foam. In yet another embodiment, the pads 12 are circularly shaped. In still yet another embodiment, the plurality of pads 12 comprises a first absorber 14 that is centrally positioned above and adjacent to the front opening of the helmet. This embodiment also comprises a pair of second absorbers 16 and two pairs of third absorbers 18. The second absorbers 16 extend from the first absorber 14 linearly along a centerline of the helmet to a back of the helmet. Each pair of third absorbers 18 is positioned between the first absorber 14 and a point above a respective earhole of the helmet. In still yet another embodiment, each pad 12 is selectively contoured so that the pad 12 resembles an object, such as a paw.

A plurality of first couplers 20 is coupled to the helmet. Each of a plurality of second couplers 22 is coupled to a respective pad 12. The second couplers 22 are complementary to the first couplers 20. The second couplers 22 are positioned on the pads 12 such that each second coupler 22 is positioned to couple to a respective first coupler 20 to couple the pad 12 to the helmet. In one embodiment, each second coupler 22 and the respective first coupler 20 comprise a snap connector 24. In another embodiment of the invention, the plurality of pads 12 is integral to the helmet.

In use, the second couplers 22 are positioned on the pads 12 such that each second coupler 22 is positioned to couple to the respective first coupler 20 to couple the pad 12 to the helmet. The pads 12 are positioned on the helmet so that the pads 12 are configured to absorb the force from the impact to the helmet when the helmet is positioned on the head of the user. The force of the impact to the head of the user is reduced.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A padding assembly comprising:

a plurality of pads configured for coupling to an external surface of a helmet, wherein said pads are positioned on the helmet such that said pads are configured for absorbing a force from an impact to the helmet when the helmet is positioned on a head of a user such that the force of the impact to the head of the user is reduced, said plurality of pads comprising a first absorber centrally positioned above and adjacent to the front opening of the helmet;

a pair of second absorbers extending from said first absorber linearly along a centerline of the helmet to a back of the helmet; and two pairs of third absorbers, each said pair of third absorbers being positioned between said first absorber and a point above a respective earhole of the helmet spaced apart and such that each of said third absorbers is fully positioned vertically above a line extending between a top of the front opening and a top of the earhole.

2. The assembly of claim 1, further including said pads comprising foam.

3. The assembly of claim 2, further including said pads comprising pliable foam.

4. The assembly of claim 1, further including said pads being circularly shaped.

5. The assembly of claim 1, further including said pads being selectively contoured such that each pad resembles a paw.

6. The assembly of claim 1, further comprising:

a plurality of first couplers coupled to the helmet;

a plurality of second couplers, each said second coupler being coupled to a respective said pad, said second couplers being complementary to said first couplers; and wherein said second couplers are positioned on said pads such that each said second coupler is positioned for coupling to a respective said first coupler to couple said pad to the helmet.

7. The assembly of claim 6, further including each said second coupler and said respective said first coupler comprising a snap connector.

8. The assembly of claim 1, further including said plurality of pads being integral to the helmet.

9. A padding assembly comprising:

a plurality of pads configured for coupling to an external surface of a helmet, wherein said pads are positioned on the helmet such that said pads are configured for absorbing a force from an impact to the helmet when the helmet is positioned on a head of a user such that the force of the impact to the head of the user is reduced, said pads comprising foam, said pads comprising pliable foam, said pads being circularly shaped, said plurality of pads comprising a first absorber centrally positioned above and adjacent to the front opening of the helmet, a pair of second absorbers extending from said first absorber linearly along a centerline of the helmet to a back of the helmet, and two pairs of third absorbers, each said pair of third absorbers being positioned between said first absorber and a point above a respective earhole of the helmet spaced apart and such that each of said third absorbers is fully positioned vertically above a line extending between a top of the front opening and a top of the earhole;

a plurality of first couplers coupled to the helmet;

a plurality of second couplers, each said second coupler being coupled to a respective said pad, said second couplers being complementary to said first couplers, wherein said second couplers are positioned on said pads such that each said second coupler is positioned for coupling to a respective said first coupler to couple said pad to the helmet, each said second coupler and said respective said first coupler comprising a snap connector; and wherein said second couplers are positioned on said pads such that each said second coupler is positioned for coupling to said respective said first coupler to couple said pad to the helmet, wherein said pads are positioned on the helmet such that said pads are configured for absorbing the force from the impact to the helmet when the helmet is positioned on the head of the user such that the force of the impact to the head of the user is reduced.

10. The assembly of claim 9, further including said plurality of pads being integral to the helmet.

11. The assembly of claim 9, further including said pads being selectively contoured such that each pad resembles a paw.

* * * * *